US011584563B2

(12) United States Patent
Sostmann

(10) Patent No.: US 11,584,563 B2
(45) Date of Patent: Feb. 21, 2023

(54) PLASTIC PALLET WITH PROTECTED RUNNERS

(71) Applicant: Georg Utz Holding AG, Bremgarten (CH)

(72) Inventor: Rüdiger Sostmann, Lingen (DE)

(73) Assignee: Georg Utz Holding AG, Bremgarten (CH)

( * ) Notice: Subject to any disclaimer, the term of this patent is extended or adjusted under 35 U.S.C. 154(b) by 22 days.

(21) Appl. No.: 17/291,432

(22) PCT Filed: Nov. 7, 2019

(86) PCT No.: PCT/IB2019/059569
§ 371 (c)(1),
(2) Date: May 5, 2021

(87) PCT Pub. No.: WO2020/099994
PCT Pub. Date: May 22, 2020

(65) Prior Publication Data

US 2022/0002027 A1 Jan. 6, 2022
US 2022/0315280 A9 Oct. 6, 2022

(30) Foreign Application Priority Data

Nov. 15, 2018 (CH) ..... 01413/18

(51) Int. Cl.
*B65D 19/00* (2006.01)

(52) U.S. Cl.
CPC ..... *B65D 19/0026* (2013.01); *B65D 2519/00034* (2013.01); *B65D 2519/00069* (2013.01);
(Continued)

(58) Field of Classification Search
CPC ..... B65D 19/06; B65D 19/0026; B65D 2519/00034; B65D 2519/00069; B65D 2519/00273
(Continued)

(56) References Cited

U.S. PATENT DOCUMENTS 3,664,271 A * 5/1972 Wolder ..... B65D 19/0012 108/57.1
4,735,154 A 4/1988 Hemery
(Continued)

FOREIGN PATENT DOCUMENTS

CH 685549 A5 8/1995
CH 702 628 A2 8/2011
(Continued)

OTHER PUBLICATIONS

International Search Report for International Application No. PCT/IB2019/059569 dated Jan. 23, 2020.

*Primary Examiner* — Jose V Chen
(74) *Attorney, Agent, or Firm* — McCormick, Paulding & Huber PLLC

(57) ABSTRACT

The invention relates to a plastic pallet comprising an upper part, which is provided with outer and central female foot parts, and runners, which are provided with outer and central male foot parts. When plugged together with the female foot parts, the male foot parts form foot elements, and the female foot parts of the upper part and the male foot parts of the runners can be secured by means of a snap-fit connection. The female foot parts have an outer wall which surrounds their respective male foot parts. The outer wall of the outer female foot part extends over the entire height of the outer male foot part such that the outer male foot parts of the runners can be completely slid into the outer female foot parts of the upper part in such a manner that the outer wall
(Continued)

of the outer female foot part together with the runner forms a support surface.

12 Claims, 8 Drawing Sheets

(52) U.S. Cl.
CPC ..... *B65D 2519/00273* (2013.01); *B65D 2519/00288* (2013.01); *B65D 2519/00323* (2013.01); *B65D 2519/00333* (2013.01); *B65D 2519/00407* (2013.01); *B65D 2519/00412* (2013.01); *B65D 2519/00567* (2013.01); *B65D 2519/00796* (2013.01)

(58) Field of Classification Search
USPC ..... 108/57.25, 57.26, 56.3
See application file for complete search history.

(56) References Cited

U.S. PATENT DOCUMENTS

| | | | | |
|---|---|---|---|---|
| 5,483,899 | A | 1/1996 | Christie | |
| 6,029,583 | A * | 2/2000 | LeTrudet | B65D 19/0012 108/57.25 |
| 6,283,044 | B1 * | 9/2001 | Apps | B65D 19/0022 108/57.25 |
| 6,564,725 | B2 * | 5/2003 | Hale | B65D 19/0012 108/57.25 |
| 7,779,765 | B2 * | 8/2010 | Donnell, Jr. | B65D 19/0016 108/56.1 |
| 8,770,115 | B2 * | 7/2014 | Apps | B65D 19/0004 108/57.25 |
| 2003/0061974 | A1 * | 4/2003 | Smyers | B65D 19/0012 108/57.33 |
| 2003/0136314 | A1 * | 7/2003 | Smyers | B65D 19/0012 108/57.26 |
| 2007/0186826 | A1 * | 8/2007 | Kuo | B65D 19/0038 108/56.3 |
| 2009/0212049 | A1 | 8/2009 | Anhel | |
| 2011/0259249 | A1 * | 10/2011 | Ogburn | B65D 19/0038 108/57.33 |
| 2014/0137775 | A1 * | 5/2014 | Plattner | B65D 19/001 108/57.26 |
| 2022/0009672 | A1 * | 1/2022 | Shawaf | B65D 19/38 |

FOREIGN PATENT DOCUMENTS

| | | | | |
|---|---|---|---|---|
| DE | 103 02 491 | A1 | 8/2004 | |
| DE | 20 2008 011 418 | U1 | 1/2009 | |
| EP | 1829787 | A1 * | 9/2007 | B65D 19/0016 |
| EP | 2 733 084 | A1 | 5/2014 | |
| GB | 2 421 939 | A | 7/2006 | |

* cited by examiner

PLASTIC PALLET WITH PROTECTED RUNNERS

CROSS-REFERENCE TO RELATED APPLICATIONS

This application is a National Stage application of International Patent Application No. PCT/IB2019/059569, filed on Nov. 7, 2019, which claims priority to Swiss Patent Application No. CH 01413/18, filed on Nov. 15, 2018, each of which is hereby incorporated by reference in its entirety.

TECHNICAL FIELD OF THE INVENTION

The invention relates to a plastic pallet having an upper part and three or more runners.

BACKGROUND OF THE INVENTION

Pallets are used for storage and transportation of goods. The pallets keep the goods off the ground so that they can be lifted and transported by a lift truck. They usually consist of a flat upper part and, in the case of 1200×800 mm pallets, of three runners, which can be manufactured in one piece by injection molding or in several parts. Multi-part plastic pallets are easier and cheaper to produce and consist, for example, of an upper part and a lower part, which are interlocked and joined together. The lower part usually has three runners and nine feet.

The upper part and the lower part, or the runners respectively, can be joined together by welding, as described in CH702628 or CH685549. When the upper part is welded to the lower part, a bead is formed which must be removed with a milling operation so that the pallet has a smooth surface. This is time-consuming and expensive.

Furthermore, the plurality of parts can be connected to each other via snap locks. GB2421939 discloses a plastic pallet with a flat upper part and a flat lower part as well as nine separate feet by means of which the upper and lower parts are connected to one another, with both ends of the feet being fastened to the upper and lower parts of the pallet by means of snap-fits.

U.S. Pat. No. 5,483,899 discloses a pallet having a lower part and an upper part which can be slid into one another, wherein the lower part of the pallet has ribs with a snap element which is arranged at the upper end of each rib. By means of this snap element at the upper end of the ribs of the lower part of the pallet, the snap-fit connection with the upper part is effected.

A plastic pallet is known from EP2733084 having an upper part and a lower part, wherein the foot elements of the upper part and the lower part can be pushed completely into one another and locked by means of snap-fit connections. The outer area of the foot elements is formed by the runners.

The well-known multi-part plastic pallets have the disadvantage that the connection between the various parts can loosen under continuous load and the upper part separates from the feet or runners.

SUMMARY OF THE INVENTION

The present invention is now based on the object of providing a multi-part plastic pallet which allows a connection between the upper part and the runners, wherein this connection withstands the load of the impact of the pallets during transport and the pallet thus has an increased impact resistance and a longer service life.

DETAILED DESCRIPTION OF THE INVENTION

This object is solved by a plastic pallet having an upper part and runners, wherein the upper part is provided with outer and middle female foot parts and the runners are provided with outer and middle male foot parts. Preferably, the plastic pallet has three runners, each with two outer male foot parts and one middle male foot part. In this case, the male foot parts joined to the female foot parts form foot elements, and the female foot parts of the upper part and the male foot parts of the runners can be attached to each other by means of a snap-fit connection. The female foot parts have an outer wall which encloses the male foot part in each case. The outer wall of the outer female foot part extends over substantially the entire height of the outer male foot part, so that the outer male foot parts of the runners can be pushed completely into the outer female foot parts of the upper part, in such a way that the outer wall of the outer female foot part together with the underside of the runner forms a support surface.

The outer wall of the female foot parts encloses the male foot parts in such a way that the male outer foot parts are fully protected in the event of an impact. The outer wall extends over the entire height of the outer female foot part, preferably substantially around the entire foot element. The entire height means that the outer wall of the outer female foot parts extends from the upper side of the pallet to the underside of the runner, which can be placed on a support surface. Preferably, the outer wall extends around the entire foot element except for a recess for a connecting piece of the runners which connects the outer male foot parts to the middle male foot part. Thus, when the pallet is assembled, the outer wall extends on at least three sides of the outer female foot parts from the upper side of the pallet to the underside of the runner.

The outer wall of the outer female foot part forms a support surface together with the runner. The underside of the outer wall of the outer female foot part is flush with the underside of the runner.

Preferably, the plastic pallet according to the invention has three runners, preferably three longitudinal runners. This is the case, for example, with plastic pallets of the standard size of 1200×800 mm. In this case, the outer male foot parts are inserted into the outer female foot parts and form outer foot elements, which are provided on the short transverse side of the plastic pallet. The middle female and male foot parts, which form the middle foot elements, are preferably provided in the middle of the pallet across the long side.

In another embodiment, the plastic pallet has more than three runners, for example five or six runners. For example, five or six runners are preferred for pallets of size 1200×800 nm. For example, a pallet of this type is possible with five runners, of which three runners extend in one direction and two runners extend in the transverse direction along the sides of the pallet. In another embodiment, the pallet comprises six runners, three longitudinal runners and three transverse runners. In this embodiment, preferably all outer eight foot elements have outer walls which extend at least on the outer side of the foot elements, i.e. on the side which is located at the perimeter of the plastic pallet, over the entire height of the outer female foot parts.

The upper part of the plastic pallet preferably has a flat upper surface. In a preferred embodiment, the upper side has a continuous closed surface. In a further embodiment, the upper part comprises reinforcing tubes which additionally reinforce the upper side of the plastic pallet.

In one embodiment, the female foot parts and the male foot parts have a plurality of ribs extending over the entire height of each foot part. The ribs may have different cross-sections and may be, for example, T-shaped, angled, or rectangular in cross-section. The ribs of the female foot parts and the ribs of the male foot parts can be pushed completely into each other.

Preferably, the male foot parts of the runners have an inner wall with ribs which serve as spacers between the inner wall and the outer wall. These ribs also serve on the one hand as a guide when the runners are fitted together with the upper part of the pallet, and on the other hand they form a gap between the inner wall and the outer wall, which serves as additional impact protection. When the plastic pallet hits an object, the ribs can bend slightly and the distance between the inner and outer walls can be reduced for a short time, which absorbs the impact.

Depending on the desired strength of the connection between the two parts of the pallet, the foot elements may have multiple snap-fit connections. In one embodiment of the invention, each foot element has one or more pairs of snap-fit connection elements, preferably one or two pairs. In one embodiment, the foot elements may also have four pairs of snap-fit connection elements and thus four snap-fit connections, preferably in the case of the outer foot elements of the central runner. The one or more snap-fit connections further increase and secure the strength of the foot elements. A snap-fit connection is a positive connection and is formed by a female and a male snap-fit connection element, which are formed as counterparts. Preferably, the counterparts are formed by a male snap-fit connection element provided with one or two hooks and a female snap-fit connection element with recess to be connected thereto, which snap into each other when they are joined together. Such a snap-fit connection has the advantage that the connection is pressed into each other when loaded, which further strengthens the connection. In addition, this snap-fit connection has a resilient property under load.

In a preferred embodiment, the male foot parts of a single runner can be pushed into the foot parts of the upper part separately from the male foot parts of the other runners. Thus, the three runners are individually insertable into the upper part and the plastic pallet is producible from four pieces. However, it is also possible that the three runners are connected to each other and consist of one piece, so that the plastic pallet can be assembled from two pieces, the upper part and a lower part provided with runners.

The foot parts of the upper part and the foot parts of the runners are preferably integrated in one piece with the upper part and the runner, respectively. This design, together with the snap-fit connection, makes it possible to assemble a pallet from only two or four parts, respectively, and without the use of tools.

When the upper part is brought together with the runners, the male foot parts with the ribs are pushed completely into the female foot parts with the outer wall and ribs, so that their ribs are pushed completely into each other and are arranged parallel to each other over their entire length, wherein the foot elements of the pallet are formed and the inner walls of the male foot part and the outer walls of the female foot part form double walls of the foot elements. The double walls increase the strength of the foot elements so that they are more robust and can withstand impacts from a forklift truck or other objects and can therefore be used for a longer period of time.

The ribbed design of the foot elements allows for easy and quick assembly of the two parts of the pallet, and the snap-fit connection elements allow for efficient locking without the need for a tool.

The arrangement of the pallet according to the invention results in the male foot parts of the runners being protected by the female foot parts of the upper part. During transport, for example on conveyor belts or during transport by forklift trucks, the short transverse sides of the pallet with longitudinal runners frequently collide with objects end must be robust against impacts. The outer foot elements in particular are exposed to strong forces. The outer wall of the outer female foot parts, which extends over the entire height of the outer male foot parts, protects the male foot parts of the runners. When the outer foot elements collide with objects, shear forces are generated which are amplified by the weight of the transported goods on the upper side of the pallet. In the pallet according to the invention, these forces are directed into the ground via the upper side of the pallet and the female foot parts. In this case, the foot elements of the upper part are loaded and not the foot elements of the runners. As a result, the snap-fit connection withstands even strong impacts and does not loosen even under continuous load.

In contrast thereto, in conventional multi-part plastic pallets, the foot elements of the runners are loaded on impact, as described for example In EP 2733084A1. The weight of the transported goods on the upper part creates shear forces during impact which act on the connection between the upper part and the foot elements of the runners and which push the upper part away from the foot elements of the runners. With repeated loading, the connection between the upper part and the runners loosens.

Further advantages of the invention follow from the following description, in which the invention is explained in more detail by means of exemplary embodiments shown in the drawings.

BRIEF DESCRIPTION OF THE DRAWINGS

The drawings show as follows.

In the figures, the same reference numerals are used for the same elements in each case, and explanations of a particular reference numeral apply to all figures unless explicitly stated otherwise.

DESCRIPTION OF THE PREFERRED EMBODIMENTS

Figure 1A:
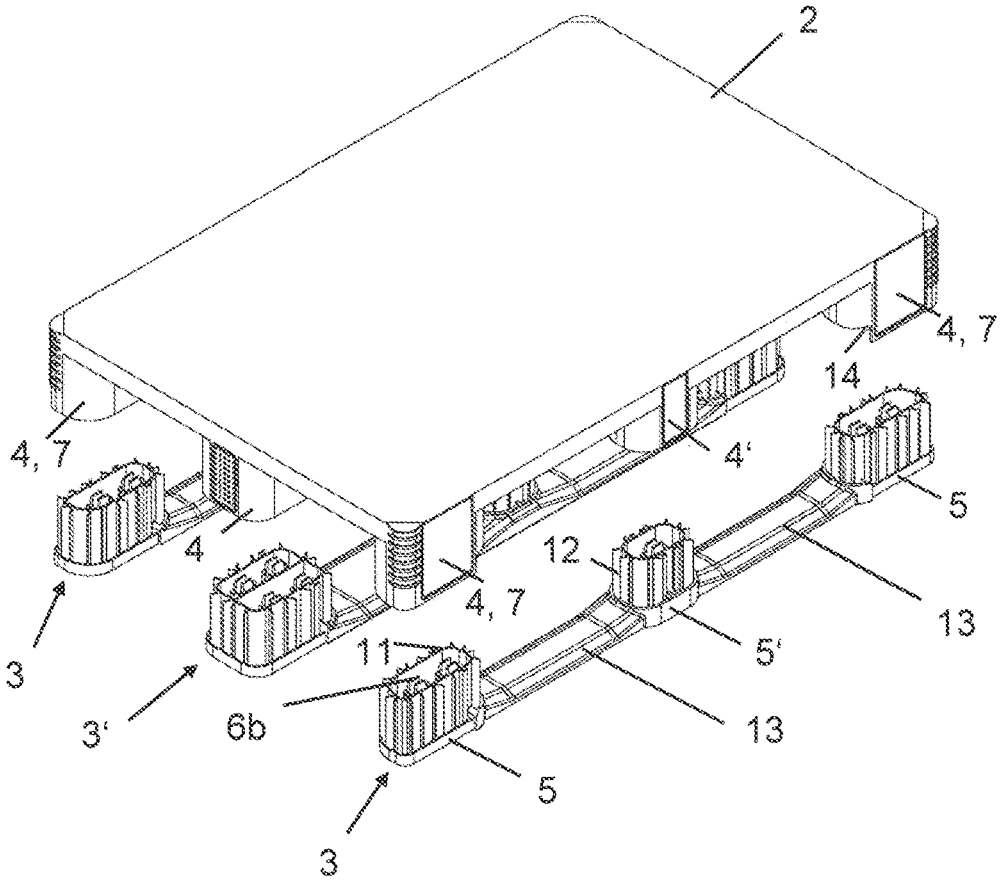
FIG. 1A shows a plastic pallet having an upper part and three runners in perspective view from oblique above with separate view of the upper part and the three runners.

FIG. 1A shows the upper part 2, the two outer runners 3 and the middle runner 3' of the plastic pallet according to the invention. The upper part 2 and the runners 3, 3' are shown in a separate and unassembled state. The upper part 2 has outer female foot parts 4, four shown here, and middle female foot parts 4', one visible here. The outer female foot parts 4 have a recess for runners 14. The runners are each provided with two outer male foot parts 5 and one middle male foot part 5'. The male foot parts 5, 5' have male snap-fit connection elements with hooks 6*b*. The outer male foot parts 5 of the outer runners 3 have two pairs of snap-fit connection elements with hooks 6*b*, the outer male foot parts 5 of the middle runners 3' have four pairs of snap-fit connection elements with hooks 6*b*, and the middle male foot parts 5' of the outer runners 3 have one pair of snap-fit connection elements with hooks 6*b*. The male foot parts 5, 5' have an inner wall 11 with ribs 12 which serve as spacers between the inner wall 11 and the outer wall 7 of the female foot parts 4, 4' and as guides when the runners are fitted together with the upper part of the pallet. The male foot parts 5, 5' are connected to each other by connecting pieces 13 and form the runner 3, 3'.

Figure 1B:
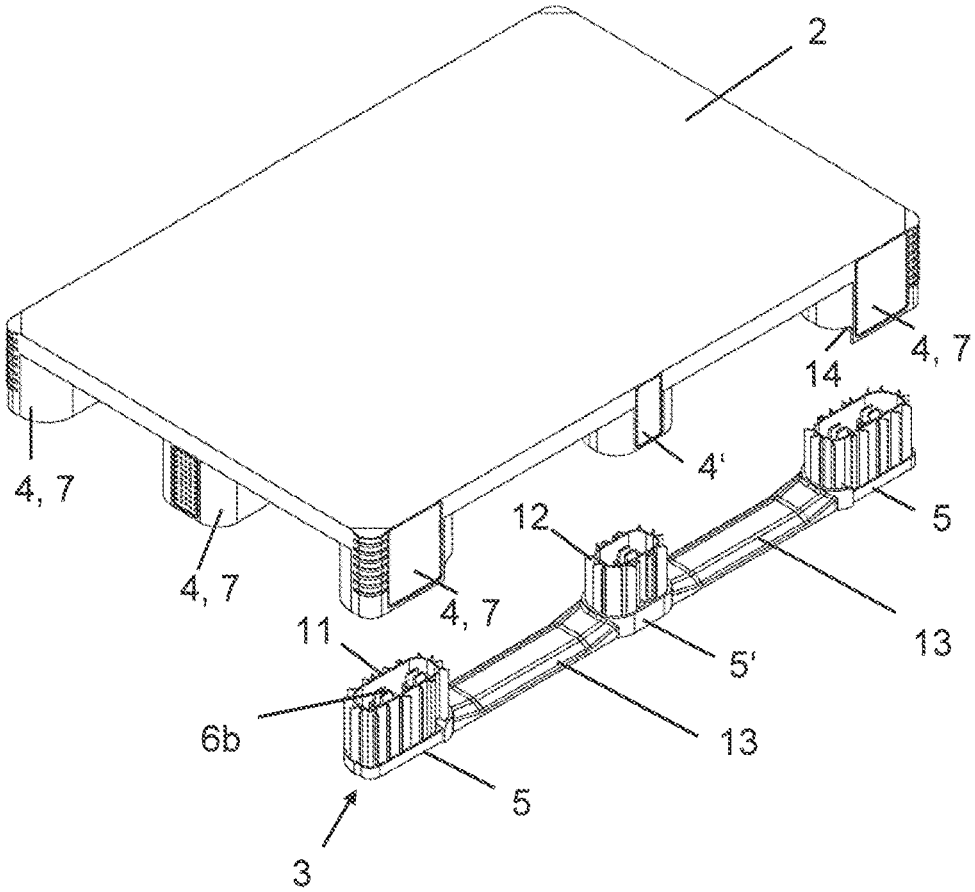
FIG. 1B shows the plastic pallet of FIG. 1A with only one runner.

FIG. 1B shows the parts of the plastic pallet described in FIG. 1A, with only one runner 3 shown in addition to tie upper part 2.

Figure 2:
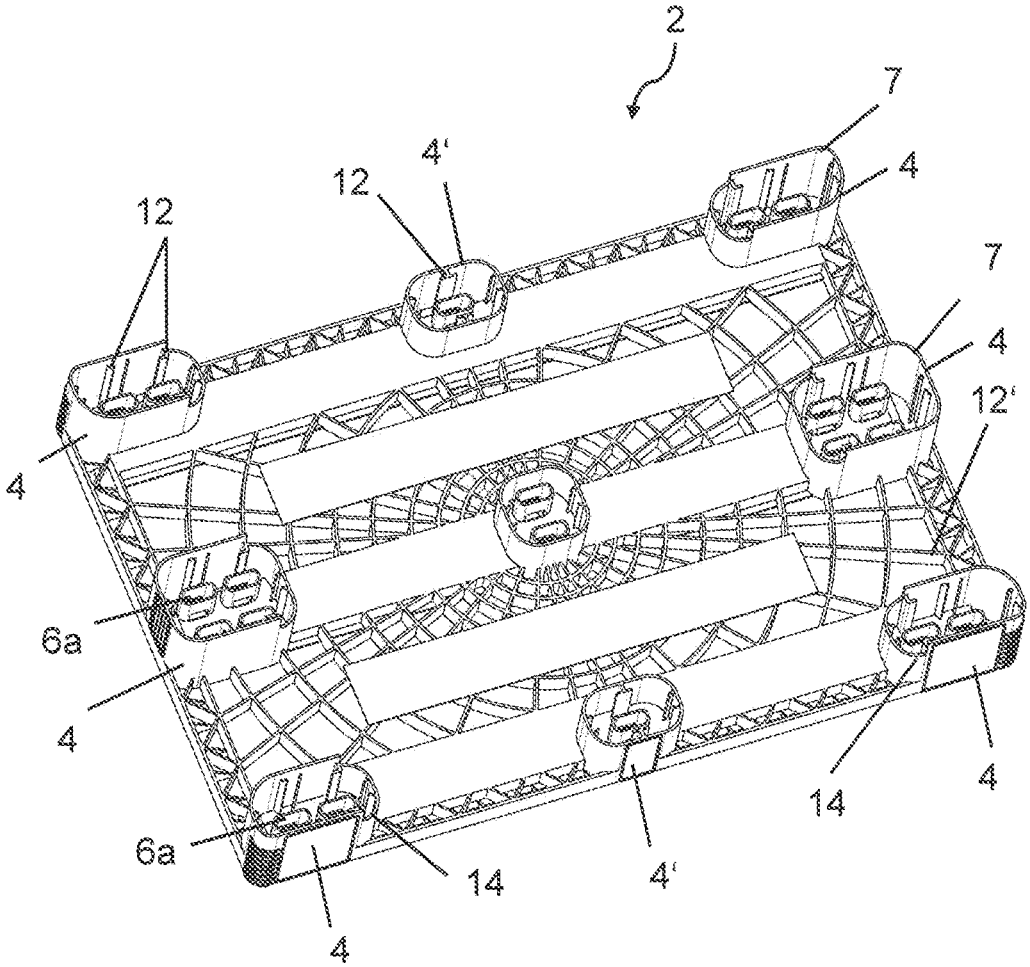
FIG. 2 shows a perspective view of the upper part from diagonally below to the underside of the upper part.

In FIG. 2, the upper part 2 of the plastic pallet is shown with a view of the underside of the upper part 2. The upper part 2 has nine female foot parts 4, 4'. Here, the six outer female foot parts 4 are arranged along the transverse side of the plastic pallet, and three middle female foot parts 4' are arranged along the centerline transverse to the longitudinal side of the pallet. The six outer female foot parts 4 have an outer wall 7 which extends in the outer region of the foot parts 4 over the entire height of the foot elements in the assembled state. The outer area of the foot parts 4 is understood to be the entire area which encloses the foot parts 4, with the exception of a recess 14 which serves to receive the connecting pieces of the runners in the assembled state. The outer wall 7 of the middle female foot parts 4' does not extend over the entire height of the foot elements and does not touch the floor when the pallet is used in the assembled state. The female foot parts 4, 4' have female snap-fit connection elements 6*a*, each with two recesses for receiving hooks. In this exemplary embodiment, the outer female foot parts 4 in the four corners of the pallet and the middle female foot part 4' in the middle of the pallet have two snap-fit connection elements with recess 6*a*, the outer female foot parts 4 arranged in the middle of the transverse side of the pallet have four snap-fit connection elements with recess 6*a*, and the middle female foot parts 4' arranged in the middle of the longitudinal side of the pallet have one snap-fit connection element with recess 6*a*. The upper part 2 has ribbed struts 12' on the underside for reinforcing the pallet. The female foot parts 4, 4' have one or more ribs extending over the entire height of each foot section. The ribs may have different cross-sections and may be, for example, T-shaped, angular or rectangular in cross-section. The ribs of the female foot parts and the ribs of the male foot parts can be pushed completely into each other.

Figure 3:
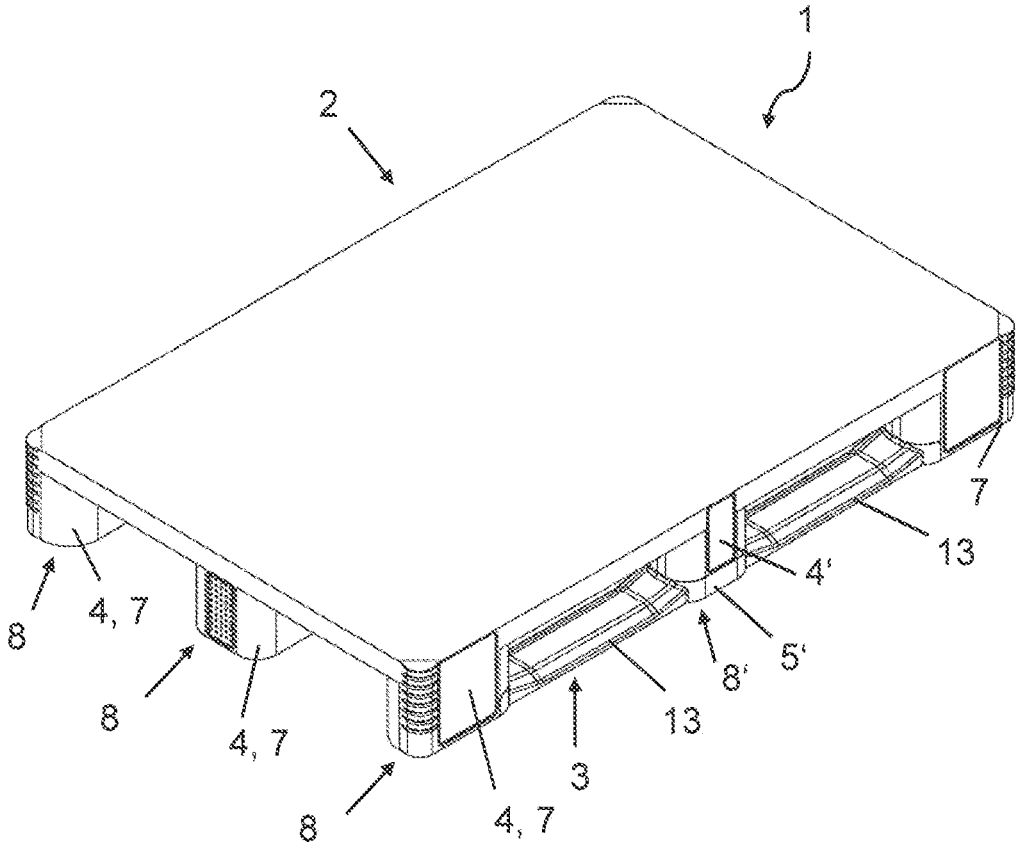
FIG. 3 shows a perspective view of the plastic pallet according to the invention in the assembled state from an oblique top view of the upper side of the pallet.

FIG. 3 shows the plastic pallet 1 according to the invention in the assembled, plugged-together state, in which the three runners 3 (here only the connecting pieces 13 of one runner 3 are visible) are plugged into the upper part 2. In this case, the runners 3, 3' shown in FIG. 1A are inserted via the male foot parts 5, 5' into the female foot parts 4, 4' (shown in FIG. 2), so that the male foot parts 5, 5' plugged together with the female foot parts 4, 4' form foot elements 8, 8', and so that the female foot parts 4, 4' of the upper part and the male foot parts 5, 5' of the runners can be fastened to each other by means of a snap-fit connection 6 (not visible). The snap-fit connection is formed by the female snap-fit connection elements with recess (6*a*, not visible, shown in FIG. 5*d*) and the male snap-fit connection elements with hook (6*b*, not visible, shown in FIG. 5*d*). The plastic pallet 1 has six outer female foot parts 4 and six outer male foot parts 5, which are arranged along the two short transverse sides of the pallet and which together form the six outer foot elements 8.

The outer wall 7 of the outer female foot parts 4 extends over the entire height of the outer male foot elements 5, so that the outer male foot elements 5 of the runners 3 can be pushed completely into the outer female foot parts 4 of the upper part. Foot elements 8 pushed together in this way have the great advantage that they remain stable in the event of impact against an object and the snap-fit connections do not become detached from one another.

Figure 4:
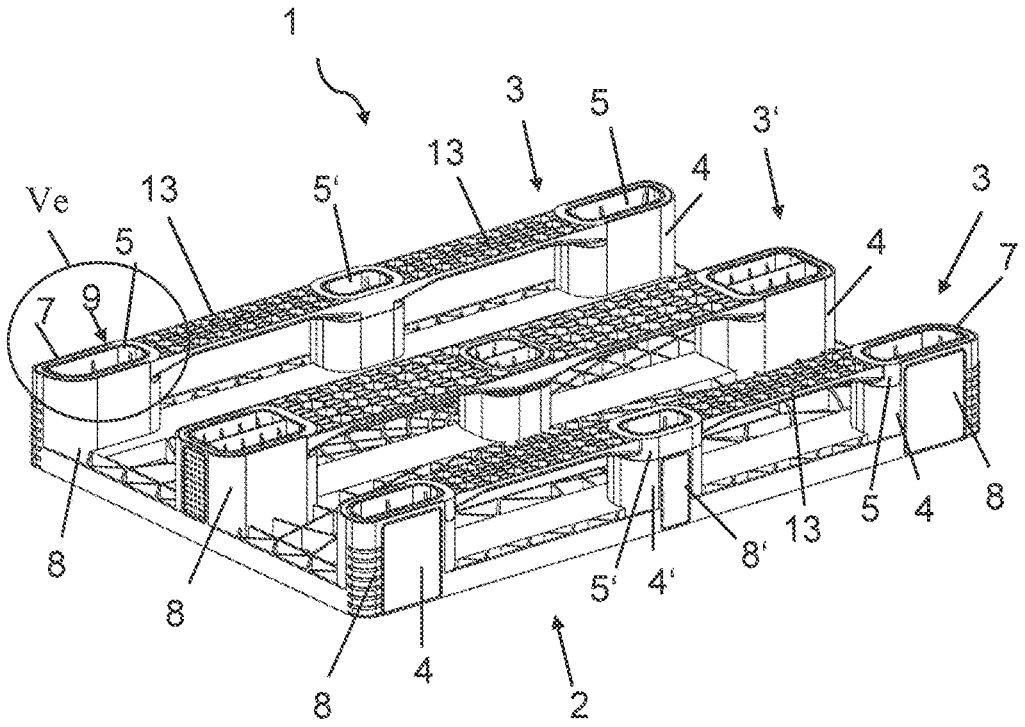
FIG. 4 shows a perspective view of the plastic pallet according to the invention in the assembled state obliquely from below onto the underside of the pallet.

In FIG. 4, the plastic pallet 1 according to the invention described in FIG. 3 is shown in the assembled state in a perspective view of the underside of the pallet. The outer wall 7 of the outer female foot part 4 forms, together with the runner 3, 3', a support surface 9 which can come into contact with the ground, for example with the floor or a conveyor belt, on which the plastic pallet 1 can be placed during transport or storage. The connecting pieces 13 of the runner 3 have on the underside, for example, a honeycomb-like grid structure which serves as reinforcement of the runner.

Figure 5A:
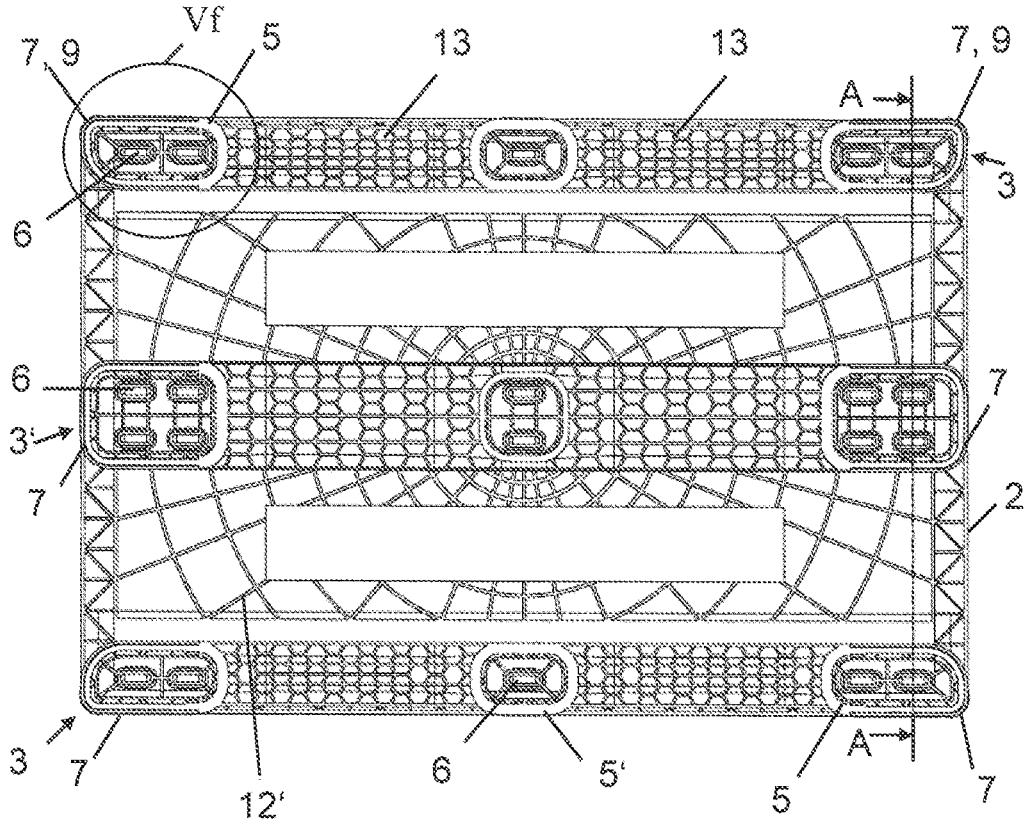
FIG. 5A shows the plastic pallet of FIG. 4 in a bottom view of the underside.

FIG. 5A shows the underside of the assembled plastic pallet 1 with a view of the underside of the outer runners 3 and the middle runner 3' and of the underside of the upper part 2 with the ribs 12'. Also shown is the underside of the snap-fit connections 6 and the connecting pieces 13 of the runners 3, 3'. The underside of the outer wall 7 of the outer female foot part together with the underside of the male foot part 5 and the runner 3, 3' form a support surface 9, which is described in more detail in FIG. 5F.

Figure 5B:
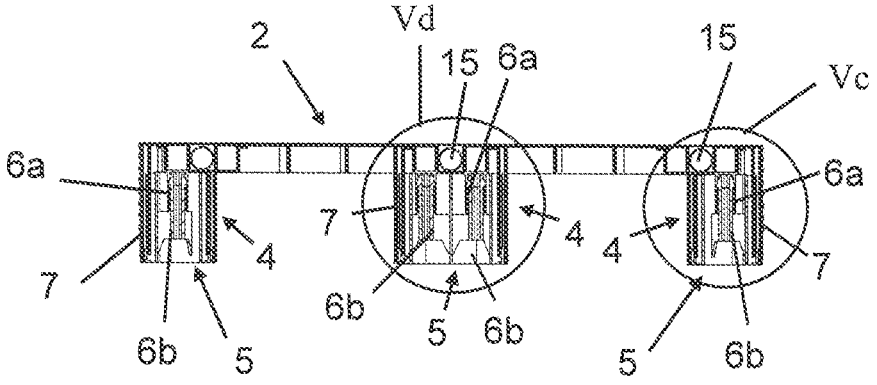
FIG. 5B shows a cross-section through the axis along line A-A of FIG. 5A.

FIG. 5B shows a cross-section through the axis along line A-A of FIG. 5A through the snap-fit connections of the outer female foot parts 4 and the outer male foot parts 5. In particular, the female snap-fit connection elements 6*a* and the male snap-fit connection elements 6*b* are disclosed, which engage with each other when the upper part 2 is plugged together with the runners and lock the upper part 2 to the runners. The upper part 2 has circular recesses 15 on the upper side of the foot elements, which recesses correspond In shape and size to a reinforcing tube, so that the recesses can accommodate a tube. The reinforcing tubes additionally reinforce the upper side of the plastic pallet.

Figure 5C:
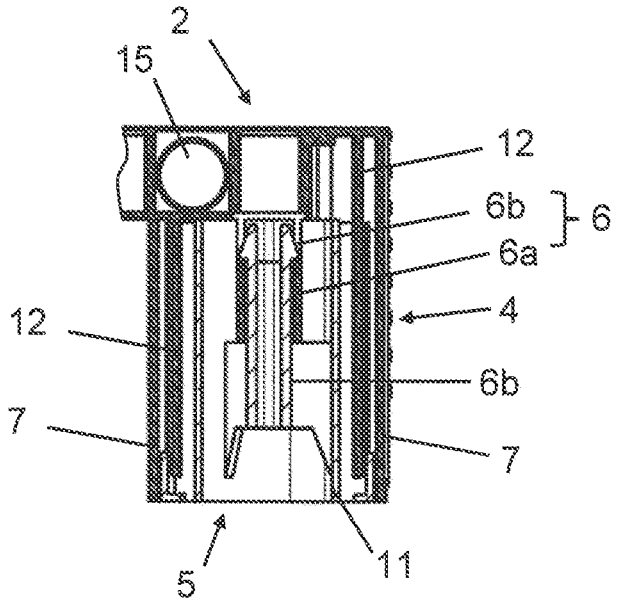
FIG. 5C shows a detailed view of the cross-section of the foot element Vc of FIG. 5B.

FIG. 5C shows a detailed view of the cross-section of the outer foot element 8 of FIG. 5B, which is arranged in a corner of the pallet. The male snap-fit connection element with hooks 6B is inserted into the female snap-fit connection element with recess 6*a*, wherein the hooks engage in the recess and form a snap-fit connection 6, thus locking the upper part 2 to the male foot elements 5. The outer wall 7 of the outer female foot part 4 encloses the outer male foot part 5 with the inner wall 11. Also shown in this cross-section are the ribs 12 of the outer female foot part 4. Due to the outer wall 7 and the inner wall 11, the foot element 8 has a double wall, which has the effect of reinforcing the foot elements. Damage to the foot elements due to impacts from a forklift truck or due to falling down is thus largely avoided.

Figure 5D:
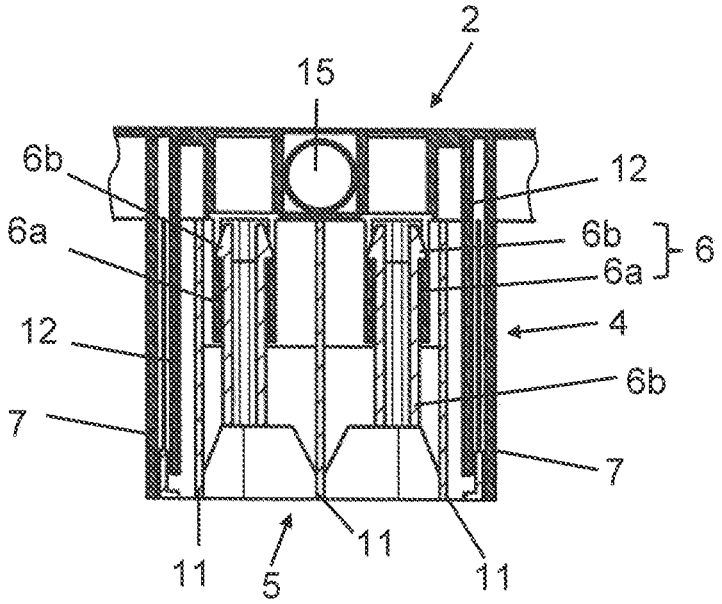
FIG. 5D shows a detailed view of the cross-section of the foot element Vd of FIG. 5B.

FIG. 5D shows a cross-section through an outer foot element of FIG. 5B as described in FIG. 5C, wherein an outer foot element is shown which is arranged in the middle of the transverse side of the plastic pallet. In this cross-section, two snap-fit connections are shown with four male snap-fit connection elements with hooks 6*b* and two female snap-fit connection elements with two recesses 6*a* each.

Figure 5E:
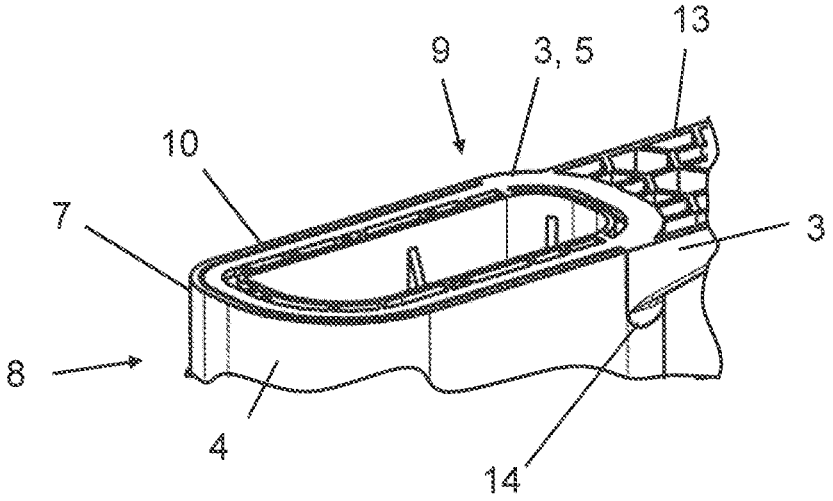
FIG. 5E shows a detailed perspective view from obliquely below of the underside of a foot element and the support surface of the runner of FIG. 4.

In FIG. 5E, a section of FIG. 4 is shown on the underside of a foot element 8, which is arranged in the corner of a plastic pallet. The underside 10 of the outer wall 7 of the outer female foot part 4, together with the underside of the outer female foot part 5 of the runner 3, forms a support surface 9. The outer female foot part 4 has a recess 14 for runners 3. With the exception of the recess 14, the outer wall 7 of the outer female foot part 4 completely encloses the outer male foot part 5. On the underside of the foot element 8, the underside 10 of the outer wall 7 has a U-shape. Thus, the outer wall 7 protects the foot element 8 on ail three sides, which would come into contact with the forks of the lift truck during transport by a forklift truck. In particular, the entire foot element 8 is protected by the outer wall 7.

Figure 5F:
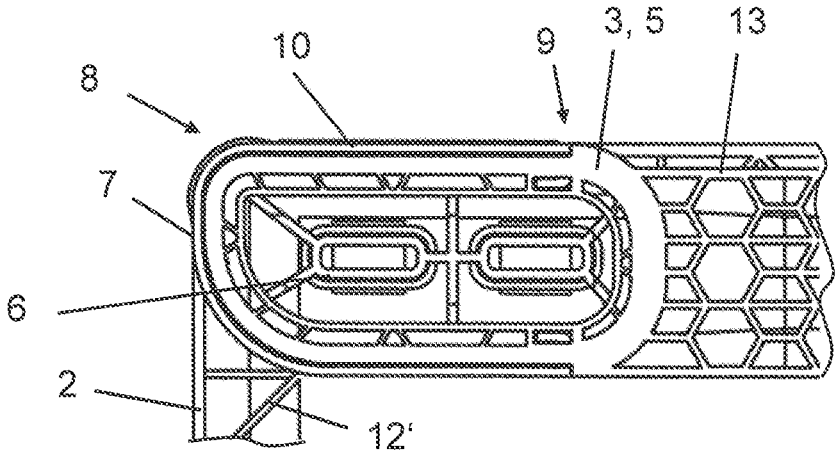
FIG. 5F shows a detailed bottom view of the underside of a foot element and the support surface of the runner of FIG. 5A.

FIG. 5F shows a section of FIG. 5A, as described in FIG. 5E, onto the underside of a corner foot element 8, showing the underside 10 of the outer wall 7, which forms a support surface 9 with the underside of the outer male foot part 5 and the connecting piece 13 of the runner 3. Also shown are the ribs 12' of the upper part 2 and the view from below of the snap-fit connections 6.

FIGS. 1-5 show a possible embodiment of the invention, wherein this embodiment has three longitudinal runners and the outer foot elements are arranged along the short transverse side of the plastic pallet. Within the terms of the invention, other embodiments are also conceivable with more than three runners in various arrangements. For example, a plastic pallet having five or six runners is possible, wherein each runner has two outer male foot parts and one middle male foot part. For example, a pallet of this type is possible with five runners, of which three runners extend in one direction and only two runners extend in the transverse direction along the sides of the pallet. Or, a pallet with Six runners is possible, with the runners arranged as three transverse runners and three longitudinal runners, so that the forklift truck can transport the pallet from both the longitudinal side and the transverse side. Also conceivable is a plastic pallet with three transverse runners, in which case the outer foot elements are arranged along the long longitudinal side. In addition, each foot element can have any number of snap-fit connections in different arrangements.

Although various embodiments of the present invention have been described and shown, the invention is not restricted thereto, but may also be embodied in other ways within the scope of the subject-matter defined in the following claims.

What is claimed is:

1. A plastic pallet having an upper part provided with outer and middle foot parts and runners provided with outer and middle foot parts, wherein the foot parts of the upper part and the foot parts of the runners can be fastened to one another by means of a snap-fit connection, wherein the outer and middle foot parts of the upper part are designed as female foot parts and the outer and middle foot parts of the runners are designed as male foot parts, wherein the male foot parts plugged together with the female foot parts form foot elements, wherein the female foot parts have an outer wall which in each case encloses the male foot parts, wherein in each case the outer wall of the outer female foot parts extends over the entire height of the outer male foot parts, so that the outer male foot parts of the runners can be pushed completely into the outer female foot parts of the upper part, wherein the underside of the outer wall of the outer female foot parts is flush with the underside of the runners, such that the outer wall of the outer female foot parts forms a support surface together with the runners, and wherein the female foot parts and the male foot parts comprise ribs which extend over the entire height of the female foot parts and the male foot parts, such that the female foot parts and the male foot parts are pushed completely into one another by means of their ribs, and thus the ribs of the female foot parts and the ribs of the male foot parts are arranged parallel to one another over the entire length of the ribs.

2. The plastic pallet according to claim 1, wherein the male foot parts of the runners have an inner wall with ribs which serve as spacers between the inner wall of the male foot parts and the outer wall of the female foot parts.

3. The plastic pallet according to claim 2, wherein each of the foot elements has one or two pairs of snap-fit connection elements.

4. The plastic pallet according to claim 2, wherein the female foot parts of the upper part are integrated in one piece with the upper part and the male foot parts are integrated in one piece with the runners.

5. The plastic pallet according to claim 2, wherein the male foot parts of a single runner can be pushed separately from the male foot parts of the other runners into the female foot parts of the upper part.

6. The plastic pallet according to claim 2, wherein the outer male foot parts and the middle male foot part of the runner are connected to each other via a connecting piece with a honeycomb-like grid structure.

7. The plastic pallet according to claim 1, wherein each of the foot elements has one or two pairs of snap-fit connection elements.

8. The plastic pallet according to claim 7, wherein the female foot parts of the upper part are integrated in one piece with the upper part and the male foot parts are integrated in one piece with the runners.

9. The plastic pallet according to claim 7, wherein the outer male foot parts and the middle male foot part of the runner are connected to each other via a connecting piece with a honeycomb-like grid structure.

10. The plastic pallet according to claim 1, wherein the female foot parts of the upper part are integrated in one piece with the upper part and the male foot parts are integrated in one piece with the runners.

11. The plastic pallet according to claim 1, wherein the male foot parts of a single runner can be pushed separately from the male foot parts of the other runners into the female foot parts of the upper part.

12. The plastic pallet according to claim 1, wherein the outer male foot parts and the middle male foot part of the runner are connected to each other via a connecting piece with a honeycomb-like grid structure.

* * * * *